United States Patent [19]

Martinmaas

[11] Patent Number: 4,757,729

[45] Date of Patent: Jul. 19, 1988

[54] ADJUSTABLE SOCKET FOR A WRENCH

[76] Inventor: Werner W. Martinmaas, c/o Nevada Motorcycle Specialties, 48 Glen-Carran Cir., Sparks, Nev. 89431

[21] Appl. No.: 875,458

[22] Filed: Jun. 18, 1986

[51] Int. Cl.[4] ..... B24B 3/00

[52] U.S. Cl. ..... 81/90.2; 81/128; 81/90.3; 81/90.6

[58] Field of Search ..... 81/128, 53.2, 90.3, 81/90.6, 90.9, 129, 90.1, 90.2; 30/134; 279/1 F, 55, 68, 66

[56] References Cited

U.S. PATENT DOCUMENTS

| | | | |
|---|---|---|---|
| 2,555,836 | 6/1951 | Werich | 81/128 |
| 2,850,931 | 9/1958 | Conway | 81/128 |
| 4,520,698 | 6/1985 | Martinmaas | 81/128 |

*Primary Examiner*—Frederick R. Schmidt
*Assistant Examiner*—Maurina Rachuba
*Attorney, Agent, or Firm*—Wood, Dalton, Phillips, Mason & Rowe

[57] ABSTRACT

An adjustable socket for turning threaded fasteners that have polygonal heads includes a core member detachably connectable to a fastener driving tool, and a pair of jaw members flanking the core member and supported thereon for longitudinal movement have forward gripping portions defining a socket. Inner surface portions of the jaw members ride on the core member to increase the span of the socket as the jaws move rearwardly on the core member, and a longitudinal slot in each jaw member cooperates with a headed stud on the core to limit the span of the socket. A compression spring surrounding the core member biases the jaw members forwardly.

10 Claims, 1 Drawing Sheet

ADJUSTABLE SOCKET FOR A WRENCH

FIELD OF THE INVENTION

The present invention relates to an adjustable socket for turning threaded fasteners that have a polygonal head, and in particular it relates to a socket that may be self-adjusting.

BACKGROUND OF THE INVENTION

Socket wrenches are extremely valuable tools because such wrenches have interchangeable sockets that mount upon a driving stub of a socket wrench head, and each socket makes a snug sliding fit upon a polygonal head of a rotatable threaded fastener which may be either a bolt or a nut. Such sockets may be used with any of several fastener driving tools which include a socket wrench as above stated, or a pneumatic nut driver, or a screwdriver type hand tool which has a shaft with a socket at the end.

Interchangeable sockets for fastener driving tools have been known for many years, and the principal objection to them is that a different socket is required for each different size of threaded fastener; and that drawback is greatly increased in the United States of America because of the continued use of English unit fasteners concurrently with the adoption of metric unit fasteners. The result is that at the present time a socket wrench set to fit all fasteners from about ¼" to about 2" requires an inordinate number of sockets.

There have been a variety of approaches to the idea of providing an adjustable socket. Those known to applicant that are believed to be most pertinent to the present application are those of applicant's own U.S. Pat. No. 4,520,698, that issued June 4, 1985, and two of the nineteen patents that were cited against that patent. Those are Conway U.S. Pat. No. 2,850,931, issued Sept. 9, 1951, and Werich U.S. Pat. No. 2,555,836, issued June 5, 1951.

SUMMARY OF THE INVENTION

In accordance with the invention, an adjustable socket for turning threaded fasteners that have a polygonal head comprises the combination of a cylindrical core member that has a rearward end portion adapted for detachably, fixedly securing the core member to a fastener driving tool, and a pair of longitudinally movable jaw members that are supported upon and flank the core member and have forward gripping portions that cooperate to form a fastener gripping socket forward of the core member. Each jaw member has inner surface portions that ride on the core member to move the gripping portions outwardly and thus increase the span of the socket as the jaw members move rearwardly, and a longitudinal slot on each jaw member provides outer surface portions that cooperate with headed studs on the core member to limit said movement outwardly. A compression spring surrounding the core member biases the jaw members forwardly.

In a preferred embodiment the inner surface portions of the jaw members are ribs that are progressively higher from their rearward to their forward ends, the longitudinal slots are progressively deeper from their rearward to their forward ends, and the heads of the headed studs have beveled undersurfaces that seat upon chamfered longitudinal margins of the slots in the jaw members.

THE DRAWINGS

DETAILED DESCRIPTION OF THE INVENTION

Figure 5:
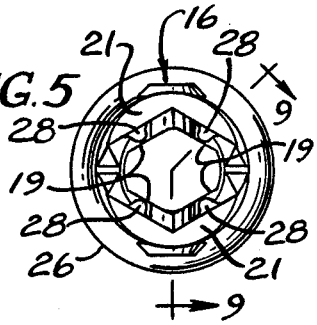
FIG. 5 is a view similar to FIG. 4 with the socket expanded as seen in FIG. 2.
Figure 8:
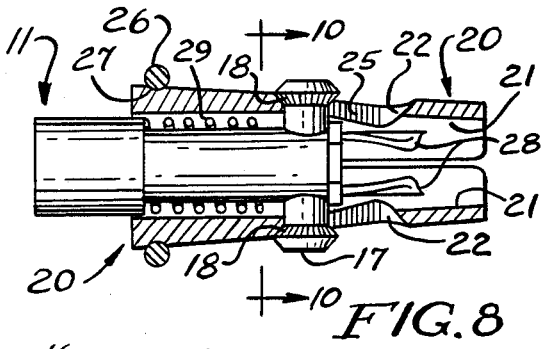
FIG. 8 is a longitudinal central sectional view taken as indicated along the line 8—8 of FIG. 4.
Figure 9:
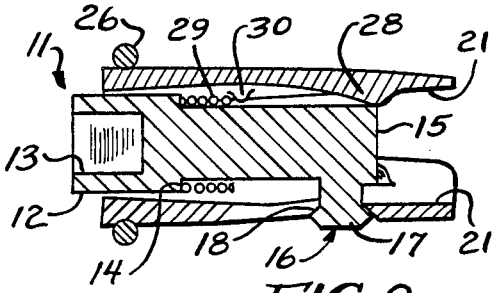
FIG. 9 is a sectional view taken substantially as indicated along the line 9—9 of FIG. 5.
Figure 10:
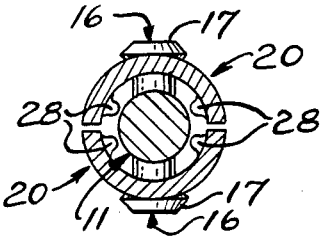
FIG. 10 is a sectional view taken substantially as indicated along the line 10—10 of FIG. 8.

Referring to the drawings in detail, the device of the invention comprises a core member, indicated generally at 11, that has a rearward end portion 12 provided with a socket 13 for detachably fixedly securing the core member to a fastener driving tool T. A circumferential offset 14 toward the rear of the core member 11 defines a forwardly facing external spring seat. Adjacent a forward end portion 15 of the core is a pair of fixed, headed studs 16 that extend in opposite directions from the core member, and as best seen in FIGS. 8 and 9 heads 17 of the studs have beveled undersurfaces 18. As best seen in FIG. 5, the forward extremity 15 of the core member 11 is provided with four planar surfaces 19.

Figure 6:
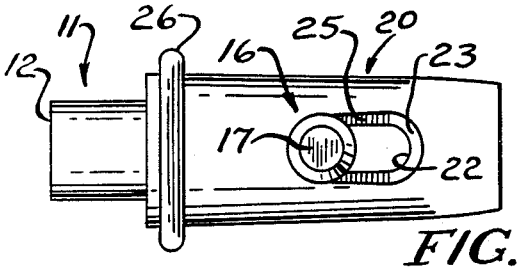
FIG. 6 is a top plan view with the jaw members in the position of FIG. 1.
Figure 7:
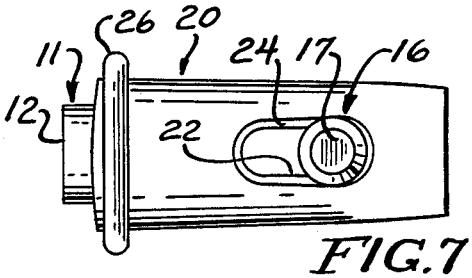
FIG. 7 is a view similar to FIG. 6 with the jaw members in the position of FIG. 2.

A pair of jaw members, each of which is indicated generally by the reference numeral 20, is supported on and flanks the core member 11 and is longitudinally movable thereon. As best seen in FIGS. 8 and 9, the jaw members 20 have opposed gripping portions 21 that cooperate to define a fastener gripping socket forward of the core member 11. Each of the jaw members 20 has a longitudinal slot 22 that has an encircling chamfered portion 23 the longitudinal sides 24 of which are best seen in FIGS. 6 and 8 to be provided with transverse striations 25. The headed studs 16 extend through the slots 22 and the beveled undersurfaces 18 of the heads 17 seat upon the chamfered portions 23, and in particular upon the striated longitudinal sides 24.

In addition to the headed studs 16, the jaw members 20 are held on the core member 11 by retaining means in the form of a ring 26 that seats in shallow grooves 27 (FIGS. 8 and 9) immediately adjacent the rearward ends of the jaw members. Thus, the retaining ring 26 acts as a hinge means about which the jaw members 20 may pivot.

Referring now again particularly to FIGS. 8 and 9, each of the jaw members 20 has inner surface portions in the form of ribs 28 that ride on the planar surfaces 19 at the forward extremity of the core member 11; and the ribs are progressively higher from their rearward ends to their forward ends so that, as the jaw members 20 slide rearwardly upon the body 11 the gripping portions 21 are moved outwardly to increase the span of the socket. As this occurs, of course, the slots 22 move rearwardly relative to the headed studs 16 so that the progressively increasing depth of the slots permits and also limits such outward movement.

Figure 1:
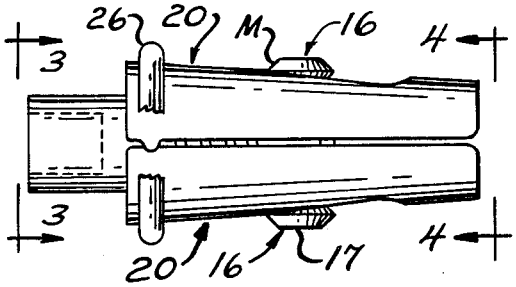
FIG. 1 is a side elevational view of an adjustable socket embodying the invention with the gripping portions of the jaw members at their minimum span.

A compression spring 29 that surrounds the core 11 is seated upon the spring seat 14 and bears upon a plurality of integral, inwardly projecting spring stops 30 on the jaw members 20, so as to bias the jaw members 20 forwardly to the position of FIG. 1 in which the span across the socket formed by the gripping portions 21 is at its minimum.

Figure 2:
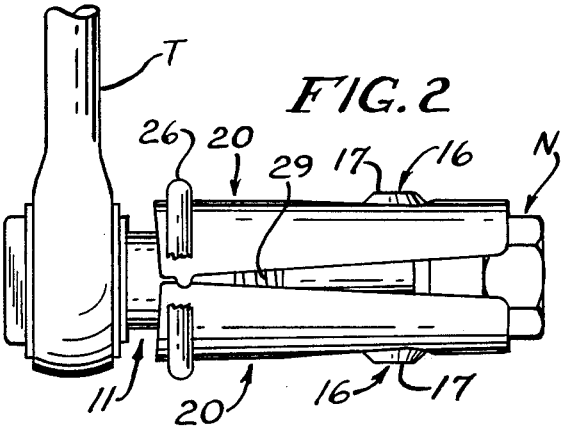
FIG. 2 is a side elevational view of the adjustable socket of the invention mounted upon a fastener driving tool and with the socket defined by the gripping portions of the jaw members expanded around a hexagonal nut.
Figure 3:
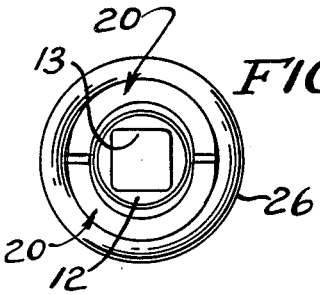
FIG. 3 is an end elevational view taken as indicated along the line 3—3 of FIG. 1.
Figure 4:
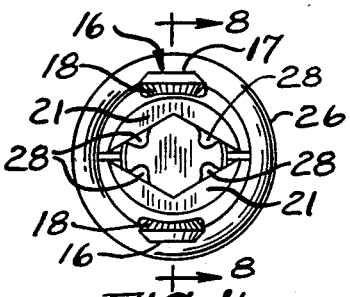
FIG. 4 is an end elevational view taken as indicated along the line 4—4 of FIG. 1.

As the adjustable socket is pushed onto a hex nut N which is larger than the minimum span across the socket, the jaw members 20 are pushed rearwardly against the bias of the spring 29 until the span across the socket is sufficient for the gripping portions 21 to slide around the nut as seen in FIG. 2. When this point is reached, engagement of the beveled undersurfaces 18 of the stud heads 17 in the striations 25 of the chamfered side portions 24 of the slots 22 fixes the jaw members in that position. When the socket is withdrawn from the nut N the spring 29 returns the jaw members 20 to their original positions.

The present device has jaw members that are hingedly connected at their rearward end portions by means of the retaining ring 26. It is apparent from my U.S. Pat. No. 4,520,698 that the jaw members could equally well be mounted for parallel movement relative to the core, as are the members 25 and 26 of the patent. This may be accomplished by providing a forward rib and a rearward rib for each jaw member 20, and also forward and rearward headed studs 16 and slots 22.

The foregoing detailed description is given for clearness of understanding only and no unnecessary limitations should be understood therefrom, as modifications will be obvious to those skilled in the art.

I claim:

1. An adjustable socket for turning threaded fasteners that have a polygonal head, said socket comprising, in combination:

a cylindrical core member that has a rearward end portion adapted for detachably, fixedly securing said core member to a fastener driving tool;

a pair of fixed studs at a forward portion of said core member, said studs having shanks that extend laterally radially outwardly in opposite directions from one another, and said studs having outer extremities provided with enlarged heads;

a pair of longitudinally movable jaw members supported upon and flanking the core member, said jaw members having forward gripping portions that cooperate to form a gripping socket forward of the core member that may span a fastener head, each jaw member having inner surface portions that ride on the core member to move the gripping portions outwardly and thus increase the span of the socket as the jaw members move rearwardly, and a longitudinal slot in each jaw member that surrounds a one of said stud shanks and slides therealong as the jaw member moves longitudinally, and said slots having peripheral longitudinal surfaces that ride beneath said enlarged heads to limit said movement outwardly and retain the forward end portions of the jaw members on the core member, and the peripheral surfaces of each of said longitudinal slots sloping progressively radially inwardly from the rear toward the front of the slot so that the span across the jaw members is at a minimum when the jaw members are at their extreme forward position and said span enlarges as the jaw members move rearwardly;

retaining means that hold the rearward end portions of said jaw members on the core member;

and a compression spring surrounding the core member that biases the jaw members forwardly and thereby urges them toward one another.

2. The combination of claim 1 in which the retaining means hingedly joins the jaw members at their rearward ends.

3. The combination of claim 2 in which the jaw members have external grooves at their rearward ends, and the retaining means comprises a ring that encircles the jaw members in said grooves.

4. The combination of claim 1 in which the heads of the headed studs have beveled undersurfaces and the peripheral longitudinal surfaces of the slots in the jaw members are chamfered to match said undersurfaces.

5. The combination of claim 4 in which the chamfered longitudinal marginal portions of the jaw member slots are roughened to enhance engagement with the beveled undersurfaces of the stud heads.

6. The combination of claim 5 in which the slots have rounded ends with radii of curvature substantially matching that of the stud heads, and the chamfered marginal portions entirely surround the slots.

7. The combination of claim 1 in which the heads of the headed studs have beveled undersurfaces, the slots have rounded ends with radii of curvature substantially matching that of the stud heads, and the slots have encircling chamfered marginal portions on which said undersurfaces seat.

8. The combination of claim 7 in which the chamfered longitudinal marginal portions of the jaw member slots are roughened to enhance engagement with the beveled undersurfaces of the stud heads.

9. The combination of claim 1 in which the inner surface portions of the jaw members are longitudinal inwardly projecting ribs that are progressively higher from their rearward ends to their forward ends.

10. A self-adjusting socket for turning threaded fasteners that have a polygonal head, said socket comprising, in combination:

a cylindrical core member that has a rearward end portion adapted for detachably, fixedly securing said core member to a fastener driving tool, and a forwardly facing external spring seat at said rearward end portion;

a pair of fixed studs at a forward portion of said core member, said studs having shanks that extend laterally radially outwardly in opposite directions from one another, and said studs having outer extremities provided with enlarged heads that have beveled undersurfaces;

a pair of longitudinally movable jaw members supported upon and flanking the core member, said jaw members having forward gripping portions that cooperate to form a fastener gripping socket forward of the core member, each jaw member having a longitudinal slot to the rear of its gripping portion through which the shank of one of the fixed studs extends, each said slot having chamfered longitudinal marginal portions upon which the beveled undersurface of the head of a stud seats and said longitudinal marginal portions of said slots sloping progressively radially inwardly from their rearward ends to their forward ends so that the span across the jaw members is at a minimum when the jaw members are at their extreme forward position and rearward movement of the jaw members permits the span across the gripping portions to increase, longitudinal inwardly projecting ribs on said jaw members that ride over the forward extremity of the core member, said ribs providing cam surfaces that are shaped to move the gripping portions of the jaw members outwardly during rearward movement of the jaws, and an internal spring stop on each jaw member;

retaining means that hold the rearward end portions of said jaw members on the core member;

and a compression spring surrounding the core member that bears on the spring seat and and the spring stops to bias the jaw members forwardly and thereby urge them toward one another.

* * * * *